US006073788A

United States Patent [19]

Stroud

[11] Patent Number: 6,073,788

[45] Date of Patent: Jun. 13, 2000

[54] TACTILE BABY BOTTLE

[75] Inventor: David J. Stroud, Piqua, Ohio

[73] Assignee: Evenflo Company, Inc., Vandalia, Ohio

[21] Appl. No.: 09/178,961

[22] Filed: Oct. 26, 1998

[51] Int. Cl.[7] ..... A61J 9/00; A61J 9/08

[52] U.S. Cl. ..... 215/11.1; 215/11.5; 215/11.6; 215/12.2

[58] Field of Search ..... 215/11.6, 12.2, 215/11.1, 11.5

[56] References Cited

U.S. PATENT DOCUMENTS

| | | | |
|---|---|---|---|
| 1,458,041 | 6/1923 | Ferris | 215/11.6 |
| 1,772,339 | 8/1930 | Cole | 215/11.6 |
| 2,150,835 | 3/1939 | Kazimirow | 215/11.6 |
| 2,685,319 | 8/1954 | Swasko | 215/11.6 X |
| 2,706,571 | 4/1955 | Ryan | 215/11.6 X |
| 2,729,259 | 1/1956 | Abrams | 215/11.6 X |
| 3,593,870 | 7/1971 | Anderson | 215/11.6 X |
| 3,661,288 | 5/1972 | Noll | 215/11.6 X |
| 3,768,683 | 10/1973 | Van Den Bosch | 215/11.6 X |
| 4,657,151 | 4/1987 | Cabernoch | 215/11.6 |
| 4,759,453 | 7/1988 | Paetzold | 215/11.6 X |

FOREIGN PATENT DOCUMENTS

| | | | |
|---|---|---|---|
| 391756 | 7/1931 | United Kingdom | 215/11.6 |
| 766082 | 1/1957 | United Kingdom | 215/11.6 |
| 2265315 | 9/1993 | United Kingdom | 215/11.6 |
| 9208435 | 5/1992 | WIPO | 215/11.6 |

*Primary Examiner*—Sue A. Weaver
*Attorney, Agent, or Firm*—Thompson Hine & Flory LLP

[57] ABSTRACT

A tactile baby bottle including a transparent, hard plastic inner layer, and a soft outer layer which provides a more convenient surface for holding and imparts increased toughness and breakage resistance to the structure.

8 Claims, 4 Drawing Sheets

TACTILE BABY BOTTLE

BACKGROUND OF THE INVENTION

1. Field of the Invention

The present invention relates to a multi-layer tactile baby bottle and more particularly pertains to improving the feel of baby bottles for infant care providers while decreasing the costs thereof.

2. Description of the Prior Art

Traditionally baby bottles were produced from glass. After World War II, plastic materials were introduced which reduced their weight and potential for breakage. The plastics chosen were either clear and hard or were produced with less hard materials that were largely opaque.

The use of baby bottles of known designs and configurations is known in the prior art. More specifically, baby bottles of known designs and configurations heretofore devised and utilized for the purpose of improving the operational capabilities of baby bottles through known methods and apparatuses are known to consist basically of familiar, expected, and obvious structural configurations, notwithstanding the myriad of designs encompassed by the crowded prior art which has been developed for the fulfillment of countless objectives and requirements.

While known prior art devices fulfill their respective, particular objectives and requirements, the aforementioned patents do not describe a multi-layer baby bottle that allows improving the feel of baby bottles for infant care providers while decreasing the costs thereof.

In this respect, the multi-layer baby bottle according to the present invention substantially departs from the conventional concepts and designs of the prior art, and in doing so provides an apparatus primarily developed for the purpose of improving the feel of baby bottles for infant care providers while decreasing the costs thereof.

Therefore, it can be appreciated that there exists a continuing need for a new and improved multi-layer baby bottle which can be used for improving the feel of baby bottles for infant care providers while decreasing the costs thereof. In this regard, the present invention substantially fulfills this need.

SUMMARY OF THE INVENTION

In view of the foregoing disadvantages inherent in the known types of baby bottles of known designs and configurations now present in the prior art, the present invention provides an improved multi-layer baby bottle. As such, the general purpose of the present invention, which will be described subsequently in greater detail, is to provide a new and improved multi-layer baby bottle and method which has all the advantages of the prior art and none of the disadvantages.

To attain this, the present invention essentially comprises a new and improved multi-layer tactile baby bottle is a system comprised of a plurality of components. Such components in their broadest context include a hard inner layer and an outer layer. The tactile baby bottle for infant feeding has a closed bottom end. It also has an open top end. The open end is adapted for the removable receipt of a nipple thereon. An imperforate side wall is located therebetween. A transparent, hard plastic inner layer, and a soft outer layer which provides a more convenient surface for holding and imparts increased toughness and breakage resistance to the structure. The hard inner layer is fabricated of a transparent plastic selected from the class of transparent plastics including polystyrene, polystyrene-acrylonitile, acrylonitile-butadiene-styrene, styrene-maleicanhydride, polycarbonate, polyethylene terephthalate, polyvinylcyclohexane and blends thereof. The outer layer is fabricated of an elastomer selected from the class of elastomers including thermoset elastomers and thermoplastic rubbers. The thermoset elastomer is selected from the class of thermoset elastomers including natural rubber, butyl rubber, nitrile rubber, chloroprene, silicone rubber, and acrylic rubber. The thermoplastic rubber being selected from the class of thermoplastic rubbers including styrene-butadiene-styrene (SBS) and like families of diblock and triblock thermoplastic elastomers, thermoplastic polyolefins (TPO's) composed of polypropylene continuous phase with dispersed rubber phase of neoprene, chlorinated polyethylene, and other crossed linked rubber dispersed phase, polyester thermoplastic elastomers, thermoplastic polyurethane (TPU) and blends thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-layer baby bottle which has all of the advantages of the prior art baby bottles of known designs and configurations and none of the disadvantages.

It is another object of the present invention to provide a new and improved multi-layer baby bottle which may be easily and efficiently manufactured at a reduced cost.

It is further object of the present invention to provide a new and improved multi-layer baby bottle which is of durable and reliable constructions.

An even further object of the present invention is to provide a new and improved multi-layer baby bottle which is susceptible of a low cost of manufacture with regard to both materials and labor, and which accordingly is then susceptible of low prices of sale to the consuming public, thereby making such multi-layer baby bottle economically available to the buying public with increased comfort for the child care provider.

Even still another object of the present invention is to provide a multi-layer baby bottle for improving the feel of baby bottles for infant care providers while decreasing the costs thereof.

Lastly, it is an object of the present invention to provide a new and improved tactile baby bottle. The baby bottle has a transparent, hard plastic inner layer. The baby bottle also has a soft outer layer. The outer layer provides a more convenient surface for holding and imparts increased toughness and breakage resistance to the structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
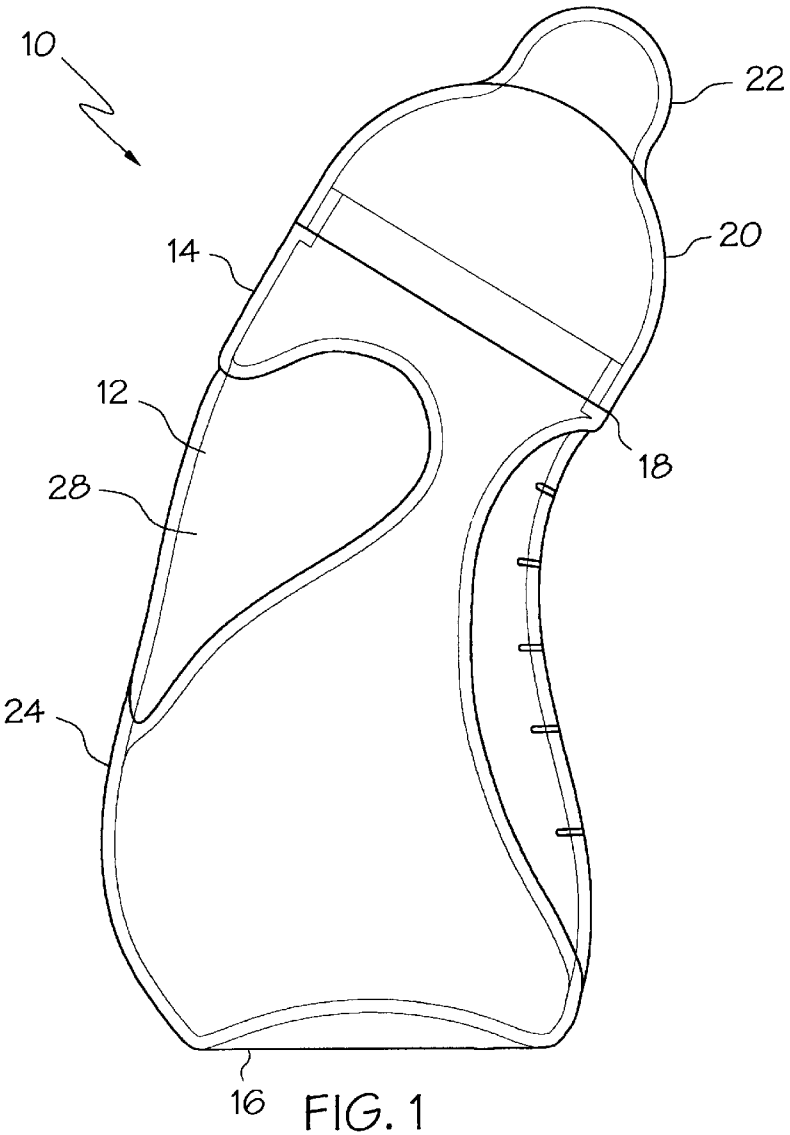
FIG. 1 is a front elevational view of the new and improved tactile baby bottle constructed in accordance with the principles of the present invention.

With reference now to the drawings, and in particular to FIG. 1 thereof, the preferred embodiment of the new and improved multi-layer baby bottle embodying the principles and concepts of the present invention and generally designated by the reference numeral 10 will be described.

The present invention, the new and improved multi-layer tactile baby bottle 10 is a system comprised of a plurality of components. Such components in their broadest context include a hard inner layer 12 and a soft, tactile outer layer 14. The tactile baby bottle 10 for infant feeding has a closed bottom end 16. It also has an open top end 18. The open end is adapted for the removable receipt of a nipple 20 thereon with a cover 22 thereover.

An imperforate side wall 24 is located between the upper and lower ends. The combination of a transparent, hard plastic inner layer and a soft outer layer provides a more convenient surface for holding while imparting increased toughness and breakage resistance to the structure.

The hard inner layer 12 is fabricated of a transparent plastic selected from the class of transparent plastics including polystyrene, polystyrene-acrylonitile, acrylonitile-butadiene-styrene, styrene-maleicanhydride, polycarbonate, polyethylene terephthalate, polyvinylcyclohexane and blends thereof.

The outer layer 14 is fabricated of an elastomer selected from the class of elastomers including thermoset elastomers and thermoplastic rubbers.

The thermoset elastomer is selected from the class of thermoset elastomers including natural rubber, butyl rubber, nitrile rubber, chloroprene, silicone rubber, and acrylic rubber.

The thermoplastic rubber being selected from the class of thermoplastic rubbers including styrene-butadiene-styrene (SBS) and like families of diblock and triblock thermoplastic elastomers, thermoplastic polyolefins (TPO's) composed of polypropylene continuous phase with dispersed rubber phase of neoprene, chlorinated polyethylene, and other crossed linked rubber dispersed phase, polyester thermoplastic elastomers, thermoplastic polyurethane (TPU) and blends thereof.

In an alternate embodiment, the outer layer 14 covers the majority of the inner layer but does not cover areas 28 to be contacted by the hand of a child are provider during use. Note FIGS. 1 and 3.

In still another alternate embodiment, the outer layer covers the majority of the inner layer but does not cover an area to be viewed for determining the extent of fullness of the bottle. Note FIGS. 2 and 3 wherein indicia is 34 molded into the inner layer to be viewed by the child care provider.

Figure 2:
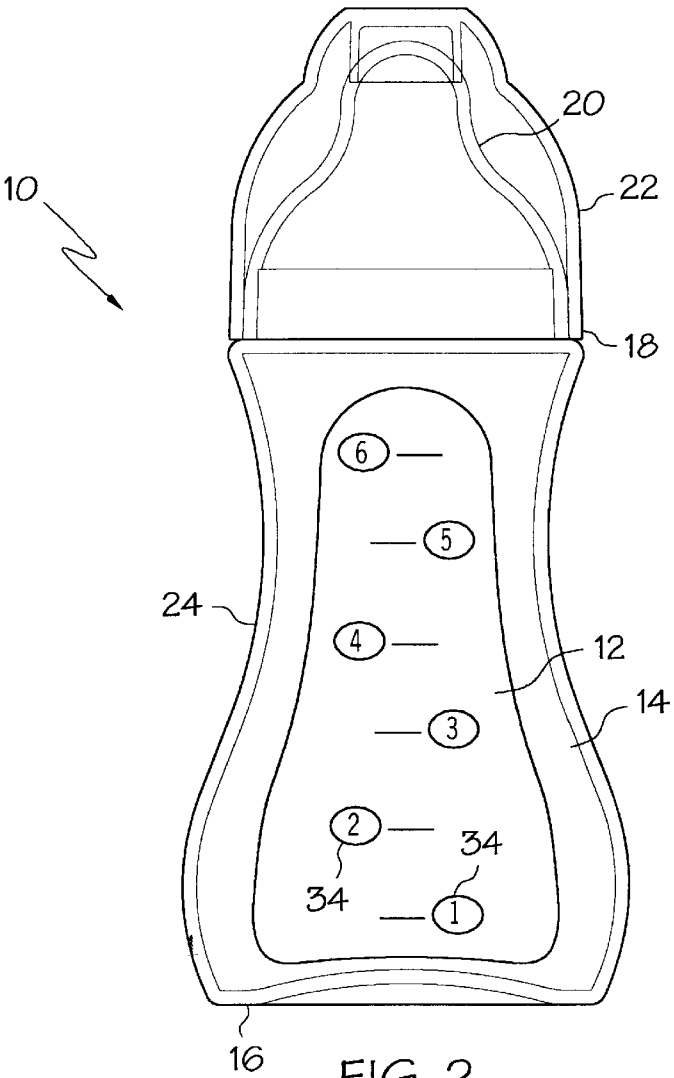
FIG. 2 is a side elevational view of the bottle shown in FIG. 1.
Figure 3:
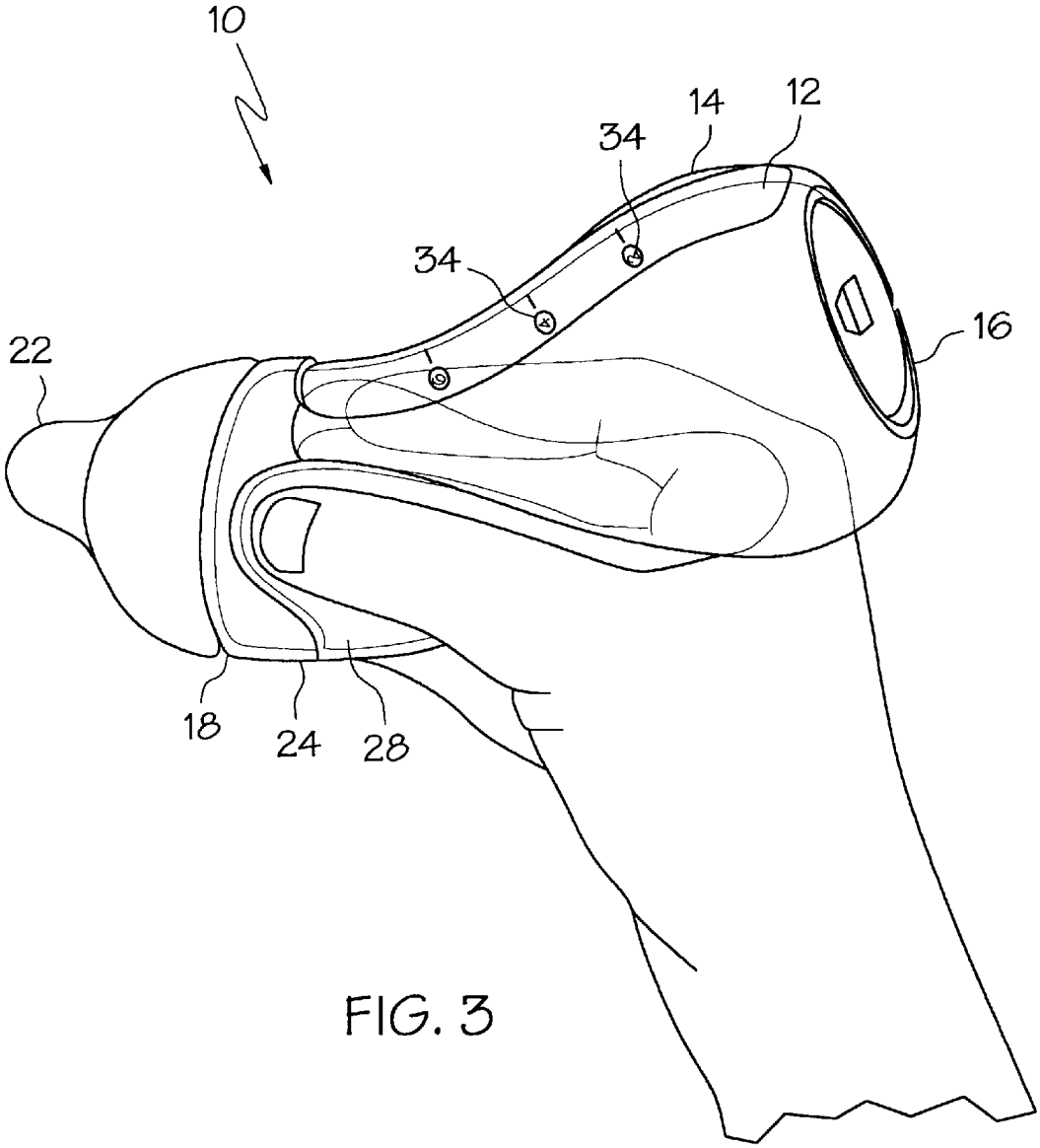
FIG. 3 is a perspective illustration of the baby bottle shown in the prior figures during operation and use.
Figure 5:
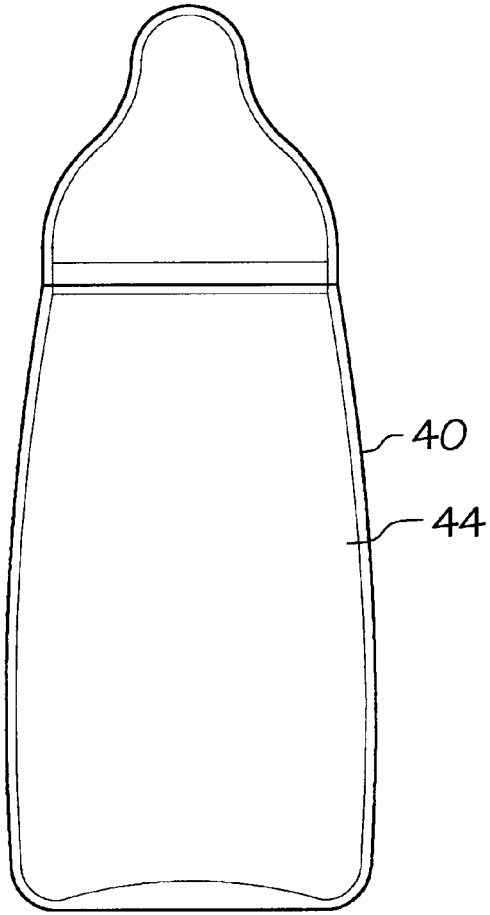
FIGS. 4 and 5 are elevational views of two alternate embodiments of the invention.
Figure 4:
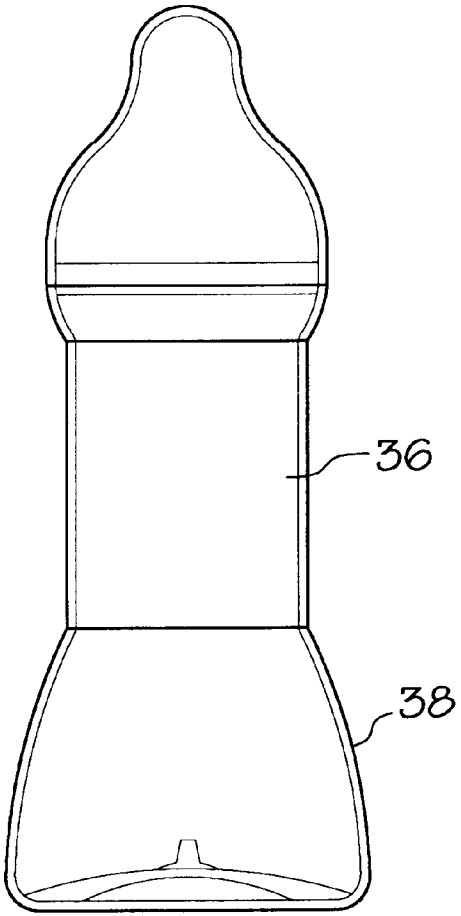
Figure 6:
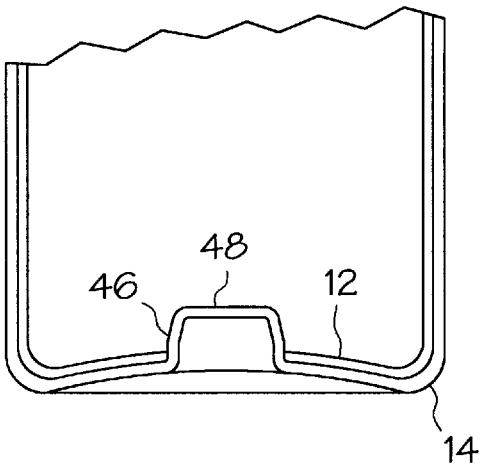
FIG. 6 is an enlarged cross-sectional view of the bottom of any of the prior embodiments.
Figure 7:
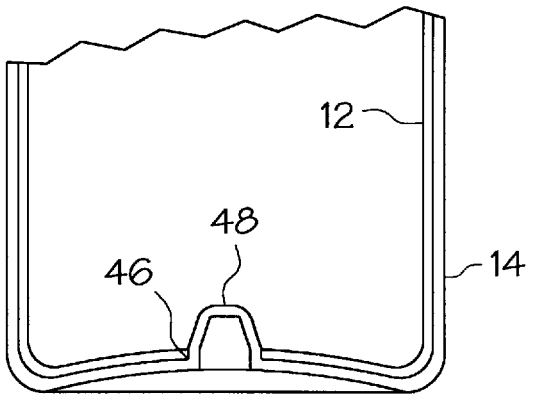
FIG. 7 is a cross-sectional view of the bottom taken at 90 degrees from the showing of FIG. 6.
Figure 8:
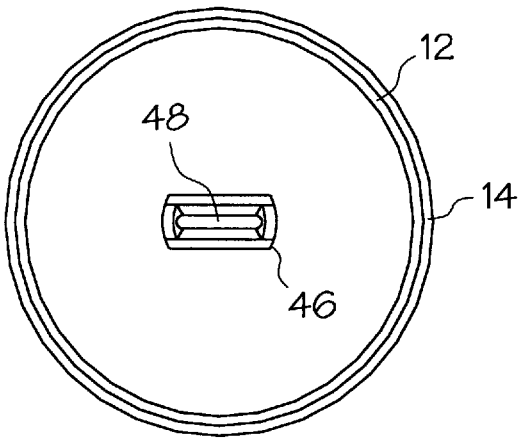
FIG. 8 is a bottom elevational view of the baby bottles of the prior embodiments.

The embodiment of FIGS. 1–3 show the preferred embodiment of the invention with a curved central axis. FIG. 4 illustrates an embodiment of a bottle 34 with a cylindrical central extent 36 and a flared bottom extent 38. FIG. 5 illustrates an embodiment of a bottle 40 with a generally cylindrical side wall but with a slight outward bow throughout.

In yet another alternate embodiment, the bottom end 16 of the bottle has a venting area 44 without an inner layer forming an aperture 46, but with an upstanding outer layer 48 forming a generally trapezoidal extension interiorly of the bottle.

The invention is a multi-layer bottle designed specifically for infant feeding which consists of a transparent, hard inner layer composed of transparent plastic and a soft outer layer which provides a more convenient surface for holding and imparts increased toughness and breakage resistance to the structure.

The hard inner layer can be composed of any transparent plastic such as polystyrene, polystyrene-acrylonitile, acrylonitile-butadiene-styrene, styrene-maleicanhydride, polycarbonate, polyetheylene terephthalate, polyvinycyclohexane, or a blend of these with themselves or with other polymers not listed.

The soft outer layer can be composed of any of the families of elastomers either thermoset or thermoplastic. Some examples of thermoset elastomers are: natural rubber, butyl rubber, nitrile rubber, chloroprene, silicone rubber, acrylic rubber. Some examples of thermoplastic rubbers are: styrene-butadiene-styrene (SBS) and like families of diblock and triblock thermoplastic elastomers; thermoplastic polyolefins (TPO's) composed of polypropylene continuous phase with dispersed rubber phase of neoprene, chlorinated polyethylene, or other crossed linked rubber dispersed base; polyester thermoplastic elastomers, thermoplastic polyurethane (TPU) or blend of these materials with themselves or other polymers not listed.

This invention allows largely transparent structures that are designed to be more comfortable and easy to hold by having the tactile layer. Further, the tactile layer offers the additional benefit of providing a tough external layer. Possible alternative applications of this outer tactile layer include the composition where the bottle is completely coated with a relatively uniform coating of rubber. The rubber may be primarily coated on only the flat surfaces of a faceted or octagonal bottle. The bottle may be designed with a hand hold coated with an elastomer. The tactile outer coating creates a sculptural aesthetic design that is also functional as a gripping surface. The rubber coating may be used to create and/or captivate a mechanical or non-mechanical vent that will allow the passage of air into the bottle to facilitate feeding.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A tactile baby bottle comprising a transparent, hard plastic inner layer and a soft outer layer which provides a more convenient surface for holding and imparts increased toughness and breakage resistance to the structure wherein said soft outer layer covers the majority of the inner layer but does not cover areas to be contacted by the hand of a child care provider during use.

2. The bottle as set forth in claim 1 wherein the hard inner layer is fabricated of a transparent plastic selected from the class of transparent plastics including polystyrene, polystyrene-acrylonitile, acrylonitile-butadiene-styrene, styrene-maleicanhydride, polycarbonate, polyethylene terephthalate, polyvinylcyclohexane and blends thereof.

3. The bottle as set forth in claim 1 wherein the outer layer is fabricated of an elastomer selected from the class of elastomers including thermoset elastomers and thermoplastic rubbers.

4. The bottle as set forth in claim 3 wherein the thermoset elastomer is selected from the class of thermoset elastomers including natural rubber, butyl rubber, nitrile rubber, chloroprene, silicone rubber, and acrylic rubber.

5. The bottle as set forth in claim 3 wherein the thermoplastic rubber is selected from the class of thermoplastic rubbers including styrene-butadiene-styrene (SBS) and like families of diblock and triblock thermoplastic elastomers, thermoplastic polyolefins (TPO's) composed of polypropylene continuous phase with dispersed rubber phase of neoprene, chlorinated polyethylene, and other crossed linked rubber dispersed phase, polyester thermoplastic elastomers, thermoplastic polyurethane (TPU) and blends thereof.

6. The bottle as set forth in claim 1 wherein the outer layer covers the majority of the inner layer, but does not cover an area to be viewed for determining the extent of fullness of the bottle.

7. The bottle as set forth in claim 1 wherein the bottom of the bottle has a venting area without an inner layer and with an upstanding outer layer.

8. A tactile baby bottle comprising a transparent, hard plastic inner layer and a soft outer layer which provides a more convenient surface for holding and imparts increased toughness and breakage resistance to the structure wherein the bottom of said bottle has a venting area without an inner layer and with an upstanding outer layer.

* * * * *